United States Patent [19]

Kiwior

[11] Patent Number: 4,479,518

[45] Date of Patent: Oct. 30, 1984

[54] METHOD AND DEVICE FOR FORMING A FILLING-YARN RESERVE FOR LOOMS

[75] Inventor: Denis Kiwior, Riedsheim, France

[73] Assignee: Societe Alsacienne de Constructions Mecaniques de Mulhouse, Mulhouse, France

[21] Appl. No.: 325,595

[22] Filed: Nov. 27, 1981

[30] Foreign Application Priority Data

Nov. 28, 1980 [FR] France ..... 80 25710

[51] Int. Cl.[3] ..... D03D 47/12

[52] U.S. Cl. ..... 139/443; 139/452

[58] Field of Search ..... 139/435, 443, 452

[56] References Cited

U.S. PATENT DOCUMENTS

| | | | |
|---|---|---|---|
| 2,089,620 | 8/1937 | Rossmann | 139/126 |
| 3,543,808 | 12/1970 | Moessinger | 139/127 |
| 4,149,572 | 4/1979 | Remond | 139/452 |

FOREIGN PATENT DOCUMENTS

| | | | |
|---|---|---|---|
| 2030343 | 12/1970 | Fed. Rep. of Germany . | |
| 1404286 | 4/1965 | France . | |
| 1562147 | 2/1969 | France . | |
| 1581247 | 9/1969 | France . | |
| 2106615 | 5/1972 | France . | |
| 2162944 | 7/1973 | France . | |
| 2288803 | 5/1976 | France | 139/452 |
| 2416187 | 7/1981 | France . | |
| 457313 | 7/1968 | Switzerland . | |

OTHER PUBLICATIONS

French Search Report and Translation thereof.

*Primary Examiner*—Henry S. Jaudon

*Attorney, Agent, or Firm*—Parkhurst & Oliff

[57] ABSTRACT

A method and apparatus for forming a yarn reserve to feed picks to a loom in which a given length of filling yarn is accumulated in a storage chamber, and the filling yarn is retrieved and introduced into a shed by propelling means implemented by a single guidance conduit. The propelling means also acts as a tensioning element for the yarn when it is propelled.

25 Claims, 9 Drawing Figures

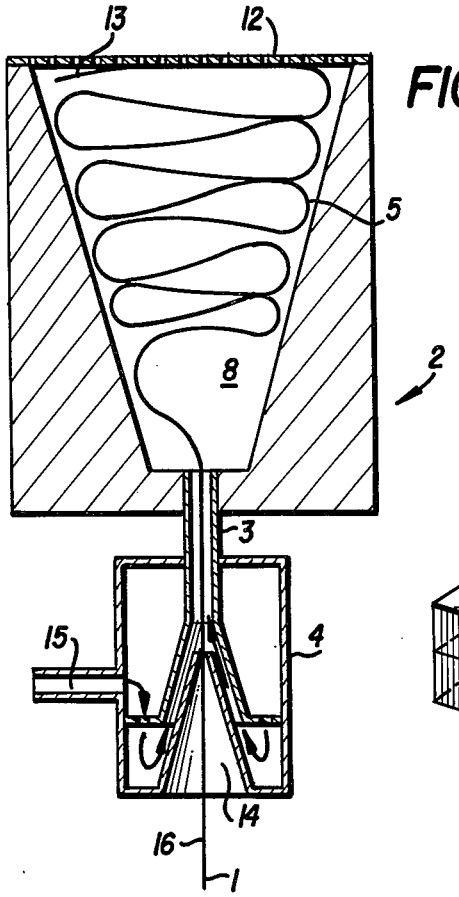
FIG. 1
FIG. 2
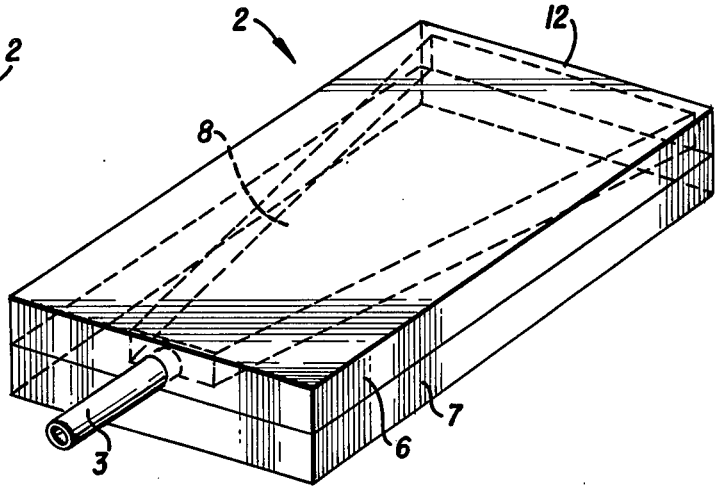
FIG. 3
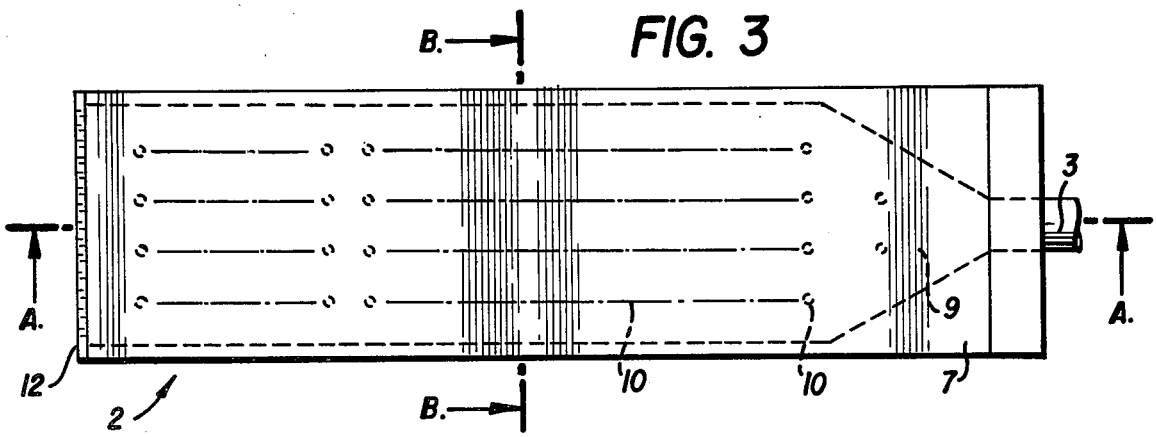
FIG. 4
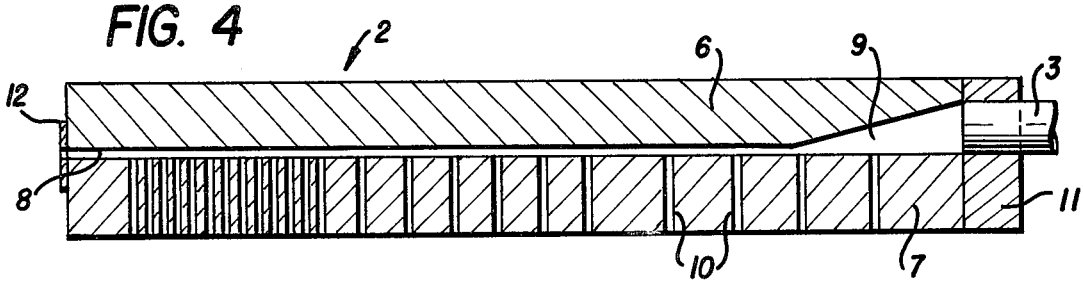

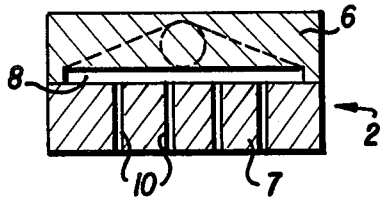
FIG. 5
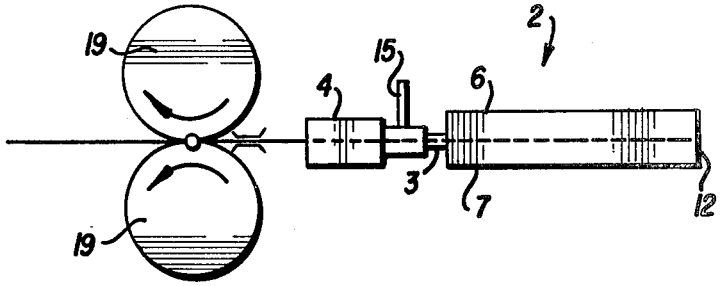
FIG. 6
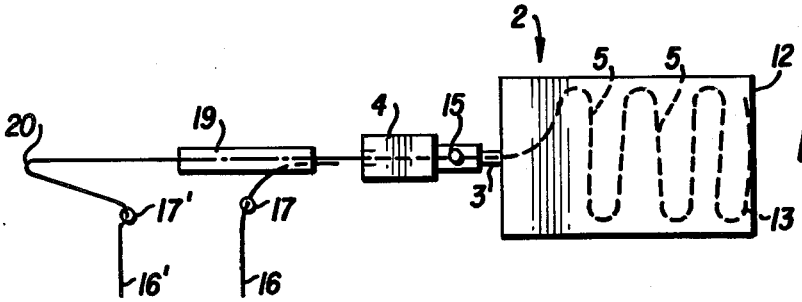
FIG. 7
FIG. 8
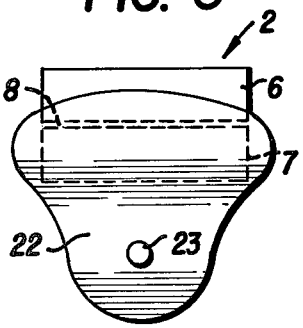
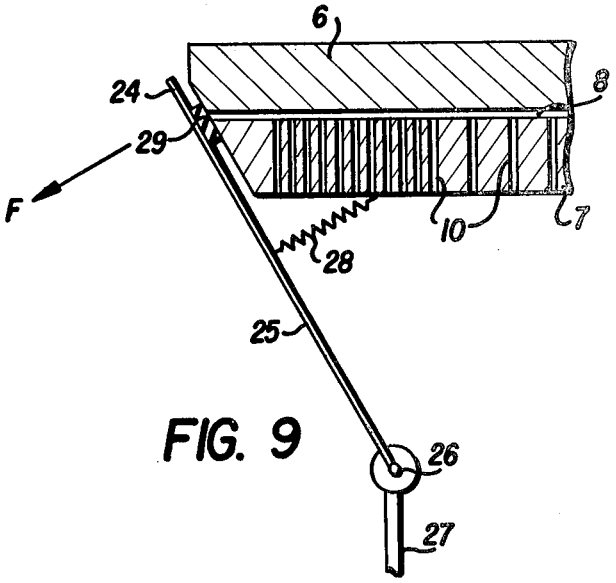
FIG. 9

METHOD AND DEVICE FOR FORMING A FILLING-YARN RESERVE FOR LOOMS

BACKGROUND OF THE INVENTION

The present invention relates to the textile industry and more particularly concerns a method and a device for forming a reserve of filling yarn for those looms wherein the filling is inserted into the shed without being carried by means reciprocating within said shed.

A number of looms make use of fluid means such as air or water jets to propel the filling through the shed. Another technique is known as "inertial insertion," and is described in particular in French Pat. No. 1,562,147 (corresponding to U.S. Pat. No. 3,543,808). This technique consists in propelling the filling of the form of a loop into the shed. One of the strands of said loop, termed the "propelled strand," has a free end and is propelled at high speed in a given direction, namely inside the shed formed by the gap between the warp yarns. The other strand, called the "slave strand" is kept in a tong outside the shed. In this manner the kinetic energy of the propelled strand is transformed in the loop into a force pulling the yarn in the direction of the loop motion. In every machine the filling yarn must be prepared in advance in the form of picks of which the length corresponds to the desired width and which are stored by a stocking means before being propelled into the shed.

Various techniques allow making such known yarn reserves. Some are called dynamic, for instance making use of a mobile member rotating about its axis in synchronization with the insertion frequency of the picks. This solution suffers from the major drawback that it requires a reliable and accurate control which must always be obtained by complex engineering and which is therefore quite expensive. Such a solution is described, for instance, in French Pat. No. 2,416,187.

Another technique, called static, is described in particular in French Pat. No. 1,581,247. The main drawback of the various embodiments of this technique is their very substantial bulk. An improvement in the static reserves is offered in French Pat. No. 2,162,944. Though the method and the device described in this document are appealing, their applicability as regards the means for propelling the pick into the shed is limited considering that the yarn necessarily must be extracted at the end opposite to its introduction.

SUMMARY OF THE INVENTION

The present invention comprises a method and device for its implementation which are both simple and effective and of low bulk, and which overcome the drawbacks of the earlier patents and permit effective storage of a specific length of filling yarn. Moreover, this method and device ensure that the yarn shall be at a proper and constant tension when inserted into the shed.

Also, the invention may be used on looms utilizing, as means for propelling the filling through the shed, either by fluid means such as air or water jets or by means implementing the "inertial insertion" technique. For the sake of brevity and clarity in the following description, the invention will be described more particularly in relation to this latter technique, but this is by no means intended to limit the full scope of the invention.

In general, the invention relates to a method for forming a reserve of yarn to feed picks to a loom, this method consisting of the steps of accumulating a given length of filling yarn in a storage chamber located between the yarn supply source (spool) and the machine side where the pick must be inserted, then removing said yarn in said reserve within said storage chamber to introduce it into the shed. The method of the invention is characterized in that the introduction of the yarn into the storage chamber and its retrieval for purposes of being projected are implemented by a single assembly allowing on one hand introduction of the yarn into said storage chamber and on the other hand also acting as a tensioning element on the yarn when the yarn is being propelled.

Advantageously, the yarn is introduced into the storage chamber by a compressed fluid jet directed towards the inside of said chamber, this fluid escaping through its walls and generating inside of it a turbulence whereby the yarn can be arranged in the form of loops juxtaposed in more or less regular manner and acting as a brake during the pick retrieval in the propelling phase inside the shed.

The invention and the advantages it offers will be better understood in relation to the drawings and the description and illustrative embodiments provided herebelow, without being limited or restricted thereby.

BRIEF DESCRIPTION OF THE DRAWING

FIG. 1 is a schematic longitudinal section of an embodiment of a device of the invention;

FIG. 2 is a perspective view of an embodiment of a yarn storing chamber for the implementation of the invention;

FIG. 3 is a top view illustrating in detail another embodiment of a storage chamber implementing the invention, the device for introducing the yarn into this chamber and tensioning the yarn during its retrieval being omitted;

FIG. 4 is a sectional elevation along the axis A—A in FIG. 3;

FIG. 5 is a sectional end view along the axis B—B in FIG. 3;

FIG. 6 is a side view of an embodiment of a device according to the invention during the pick insertion by the so-called "inertial technique";

FIG. 7 is a top view of the embodiment of FIG. 6;

FIG. 8 and 9 illustrate two variations in the design of the system for sealing the end of a yarn storage chamber used in implementation of the invention.

DETAILED DESCRIPTION

Referring now to the attached figures, and in particular to FIGS. 1, 6, and 7, a reserve of the yarn 1 of a given length for the purpose of feeding picks to a loom (not shown) is achieved as follows: first, during the formation of the reserve, the yarn 1 is withdrawn from a spool and is inserted inside a storage chamber 2 located between the supply spool and the side of the machine where the pick will be introduced. The reserve of yarn stored in the storage chamber 2 can be retrieved from this chamber at the proper time and propelled into the shed formed by the loom's warp yarns.

In conformity with the invention, the yarn 1 is introduced into the storage chamber 2 and retrieved from it by any suitable propelling means through a single orifice or guide conduit 3, the means 4 for introducing the yarn 1 into the storage chamber 2 also acting as a tensioning device for the yarn 1 when the pick is retrieved from the storage chamber during the propulsion phase inside the shed.

Preferably the nozzle means 4 which both introduces the yarn 1 into the storage chamber 2 and tensions the yarn when propelled during retrieval, consists of a compressed fluid (for instance, air) nozzle, the fluid flow from this nozzle being directed through the conduit 3 into the chamber 2 where it generates a turbulence whereby the yarn 1 can be arranged in more or less regularly juxtaposed loops 5. This turbulence is generated by designing the storage chamber 2 so that the air escapes through the walls. FIGS. 3, 4, and 5 illustrate in detail an embodiment of a storage chamber 2 which is particularly suitable to implementing the invention. In this embodiment, the storage chamber 2 consists essentially of two superposed parts 6 and 7. These parts 6 and 7 are joined together in a known manner, the connecting elements being omitted from the drawings for the sake of simplicity. These two parts 6 and 7 are so machined that they create a cavity 8 between them for receiving the yarn which is to be put in reserve. This cavity 8 is of a height depending on the diameter of the yarn to be treated, and preferably is between 1.2 and 1.5 times this diameter. Also, the part 6 is preferably machined to form together with the part 7 a divergent clearance 9. A piece 11 comprising a bore is fixed at the divergent clearance 9 and seats the outlet of the tube 3 through which the yarn 1 is introduced and retrieved. Moreover, in order to generate turbulence within the chamber to make possible the yarn accumulation, the part 7 is perforated with holes 10 of which only the centers are indicated in FIG. 3. These holes 10 increase in density from the nozzle 9 toward the other end 12 of the chamber. This rear end 12 of the chamber is sealed in such a manner as to allow the fluid to escape radially when the yarn is introduced into the storage chamber. This sealing is implemented for instance using a lattice means or any equivalent means such as the one shown in FIG. 8 (described below).

Such a method and device are implemented as follows.

The end 13 of the pick to be placed in reserve is placed in the intake orifice 14 of the nozzle means 4 which is fed with compressed air through pipe 15. The air is therefore introduced inside the cavity 8 of the storage chamber 2, and, in view of the structure of this chamber, escapes through the orifices 10 and the end 12, thereby generating a turbulence which bends the yarn 1 into loops 5 which are more or less uniformly juxtaposed and accumulate between the parts 6 and 7. Considering that when the yarn accumulates in the storage chamber 2 it seals an increasingly larger part of the holes 10, to compensate for this sealing phenomenon the density of these holes increases from the intake—on the side of the conduit 3—towards the end 12 on the perforated surface side of the device. It is also advantageous that the part located near the intake comprises few holes 10 so there will not be an excessive loss of compressed air. Lastly, the diameter of these holes may not exceed 2 millimeters in order to eliminate yarn catching.

Once a reserve of a given length has been accumulated in the manner described above, the filling can be inserted in the shed by any suitable means. FIGS. 6 and 7 schematically illustrate an embodiment for the case of "inertial insertion". In such an instance the end 16 of the pick placed in reserve—and projecting from nozzle means 4—is clamped in a tong 17. During propulsion, the tong 17 is displaced toward position 17' in such a manner that the pick is inserted into acceleration means consisting in the present case of two rotary propelling disks 19. The yarn is then pulled out of the storage chamber 2 through the orifice 3 by which it had entered and forms a loop 20 which propagates in the direction of the shed. During this propulsion, the air flow through pipe 15 continues, whereby a constant tension is maintained in the pick inserted into the shed. After the propulsion is over, the tong 17 opens and returns to its intial position, ready to receive a new pick.

As stated previously, it has been observed that the height of the cavity 8 of the storage chamber 2 should be of the order of 1.2 to 1.5 times the yarn diameter. It may be desirable to adjust this height as a function of the material being worked with. Such an adjustment can easily be achieved by the preferred implementation of the invention whereby the storage chamber 2 consists of two superposed parts 6 and 7. Such an adjustment for instance can be obtained using micrometer screws (not shown) which are located on the sides. Another solution is to place shims of a given height between the parts 6 and 7, said shims being arranged parallel to the length and towards the edges in the unperforated zone. It suffices therefore to insert these shims as a function of the diameter of the yarn being used.

Moreover it is possible to make use of wedge-shaped or pyramidal shaped shims of which the greater thickness is located on the yarn entry side in the storage chamber. In this manner the finest yarns will go as far as the bottom of the storage chamber whereas the biggest yarns will only go a certain distance beyond the entry. This also applies to fancy yarns with irregular diameter. Such a solution allows operating on a whole range of yarns without changing the shims.

While in the embodiments shown, more particularly in FIGS. 1, 2, 3, 4, and 5, the air is allowed to escape from the end 12 of the storage chamber 2 by making use of a perforated surface, such a design is not mandatory and other equivalent means may be resorted to.

Thus FIG. 8 illustrates another implementation of great interest, which is particularly useful when operating on yarns which tend to release lint. In the case of a perforated surface, the lint that is formed may accumulate and gradually seal the air passageway and thereby interfere with the operation of the device. In the variation shown in the FIG. 8, the perforated surface at end 12 is eliminated and a part 22 rotationally driven by a shaft 23 moves against that end of the reserve which is opposite the nozzle means 4. The part 22 is positioned on its shaft 23 in such a manner that the clearance 8 inside which the yarn accumulates will be sealed when a yarn is moved into the reserve and cleared when the reserve is empty. Preferably the surface condition of the part 22 which is opposite the reserve is such that the lint cannot catch on it. Micro-peening is very suitable to avert such catching. Therefore, during each machine cycle, the air circuit expels the lint when the reserve is empty and the clearance 8 is wholly cleansed. Also, any lint that might be on the part 22 will drop during its rotation as its surface condition prevents them from accumulating.

FIG. 9 shows another variation of the sealing method for the end 12 of the storage chamber 2. In this variation, the sealing is achieved by a metal plate 24 preferably surface-treated so as to eliminate catching plush material, for instance by micro-peening as in the above embodiment. This plate 24 is borne on a rod 25 hinging at 26. It can be displaced in the direction of the arrow F by a suitable control means diagrammatically indicated by the reference numeral 27, where this displacement takes place against the action of the return spring 28 the displacement permits clearing of the aperture 8 while the chamber is empty. Preferably, in order to clear the aperture 8 thoroughly when the sealing means 24 has pivoted, the bottom of the chamber is bevelled as indicated in FIG. 9. Moreover, to make sure that the seal is hermetic during the yarn accumulation and retrieval, a shoe 29 made of rubber or of any other resilient plastic material may be fixed to the plate 24 at the level of the aperture 8.

Obviously the invention is not restricted to the above described embodiments; rather, it covers all variations in the same spirit. For instance, the member propelling the yarn can be of another type than those using the so-called "inertial insertion". One might conceive pulling the end 16 of the yarn using a projectile or retrieving the reserve yarn by a hydraulic or pneumatic nozzle means, the insertion nozzle 4 in such a case also keeping the yarn at a constant tension while it is being propelled. Other variations on the basic concept of the invention may also be made without departing from the spirit thereof.

What is claimed is:

1. A device for forming a yarn reserve to feed picks to a loom, comprising:

(a) a storage chamber being located between a yarn supply source and a machine for inserting picks into a loom, said storage chamber having an upper part and a perforated lower part, said upper part and said lower part being machined and joined to form a divergent clearance at a first end of said chamber and said upper part and said lower part being machined and joined to form a cavity therebetween;

(b) means for introducing yarn into said storage chamber comprising a compressed-fluid nozzle, said nozzle directing fluid into said storage chamber, said fluid passing through said perforations of said lower part of said storage chamber generating an internal turbulence therein to arrange yarn in juxtaposed substantially regular loops; and (c) means for retrieving yarn from said storage chamber, said means for introducing yarn into said storage chamber tensioning the yarn upon retrieval.

2. A device as claimed in claim 1, wherein the height of said cavity is from 1.2 to 1.5 times the diameter of the yarn stored in said storage chamber.

3. A device as claimed in claim 1, wherein the perforation density of said lower part increases from said first end to a second end of said storage chamber.

4. A device as claimed in claim 3, wherein a solid part rotationally driven by a shaft is located at a second end of said storage chamber, said solid part sealing said second end during yarn introduction and said solid part opening said second end when said storage chamber is empty.

5. A device as claimed in claim 3, wherein a resilient material shoe fixed to a plate is located at a second end of said storage chamber, said shoe sealing said second end during yarn introduction.

6. A device as claimed in claim 5, wherein said second end of said storage chamber is bevelled.

7. A device as claimed in claim 3 wherein yarn is introduced into said storage chamber through said divergent clearance and is retrieved therefrom through said divergent clearance, and wherein a second end of said storage chamber is sealed by a perforated surface.

8. A device as claimed in claim 3, wherein the height of said cavity is adjustable with interchangeable parallelipedal or pyramidal shaped shims.

9. A device as claimed in claim 8 wherein yarn is introduced into said storage chamber through said divergent clearance and is retrieved therefrom through said divergent clearance, and wherein a second end of said storage chamber is sealed by a perforated surface.

10. A device as claimed in claim 8, wherein a solid part rotationally driven by a shaft is located at a second end of said storage chamber, said solid part sealing said second end during yarn introduction and said solid part opening said second end when said storage chamber is empty.

11. A device as claimed in claim 8, wherein a resilient material shoe fixed to a plate is located at a second end of said storage chamber, said shoe sealing said second end during yarn introduction.

12. A device as claimed in claim 11, wherein said second end of said storage chamber is bevelled.

13. A device as claimed in claim 1, wherein yarn is introduced into said storage chamber through said divergent clearance and is retrieved therefrom through said divergent clearance, and wherein a second end of said storage chamber is sealed by a perforated surface.

14. A device as claimed in claim 1, wherein a solid part rotationally driven by a shaft is located at a second end of said storage chamber, said solid part sealing said second end during yarn introduction and said solid part opening said second end when said storage chamber is empty.

15. A device as claimed in claim 1, wherein a resilient material shoe fixed to a plate is located at a second end of said storage chamber, said shoe sealing said second end during yarn introduction.

16. A device as claimed in claim 15, wherein said second end of said storage chamber is bevelled.

17. A device for forming a yarn reserve to feed picks to a loom, comprising:

(a) a storage chamber being located between a yarn supply source and a machine for inserting picks into a loom;

(b) means for introducing yarn at a first end of said storage chamber; and (c) means for retrieving yarn from said storage chamber, said means for introducing said yarn into said storage chamber tensioning the yarn upon retrieval;

wherein a solid part rotationally driven by a shaft is located at a second end of said storage chamber, said solid part sealing said second end during yarn introduction and said solid part opening said second end when said storage chamber is empty.

18. A device as claimed in claim 17, wherein said means for introducing yarn at a first end of said storage chamber comprise a compressed-fluid nozzle, said nozzle directing fluid into said storage chamber, said fluid passing through the walls of said storage chamber generating an internal turbulence therein to arrange yarn in juxtaposed substantially regular loops.

19. A device as claimed in claim 18, wherein said storage chamber has a divergent clearance at a first end thereof.

20. A device for forming a yarn reserve to feed picks to a loom, comprising:

(a) a storage chamber being located between a yarn supply source and a machine for inserting picks into a loom;

(b) means for introducing yarn at a first end of said storage chamber; and (c) means for retrieving yarn from said storage chamber, said means for introducing yarn into said storage chamber tensioning the yarn upon retrieval;

wherein a resilient material shoe fixed to a plate is located at a second end of said storage chamber, said shoe sealing said second end during yarn introduction.

21. A device as claimed in claim 20, wherein said means for introducing yarn at a first end of said storage chamber comprise a compressed-fluid nozzle, said nozzle directing fluid into said storage chamber, said fluid passing through the walls of said storage chamber generating an internal turbulence therein to arrange yarn in juxtaposed substantially regular loops.

22. A device as claimed in claim 21, wherein said second end of said storage chamber is bevelled.

23. A device as claimed in claim 21, wherein said storage chamber has a divergent clearance at a first end thereof.

24. A device as claimed in claim 23, wherein said second end of said storage chamber is bevelled.

25. A device as claimed in claim 20, wherein said second end of said storage chamber is bevelled.

* * * * *